US007045795B2

(12) United States Patent
Iwata

(10) Patent No.: US 7,045,795 B2
(45) Date of Patent: May 16, 2006

(54) APPARATUS FOR ACTIVATING A PRODUCT BY APPLYING PLASMA PARTICLES IN A MAGNETIC FIELD

(76) Inventor: Takuzo Iwata, 12-27 Kuzahanamiki-1 chome, Hirakata-shi, Osaka (JP) 573-1118

( * ) Notice: Subject to any disclaimer, the term of this patent is extended or adjusted under 35 U.S.C. 154(b) by 69 days.

(21) Appl. No.: 10/825,003

(22) Filed: Apr. 14, 2004

(65) Prior Publication Data

US 2004/0212313 A1 Oct. 28, 2004

(30) Foreign Application Priority Data

Apr. 25, 2003 (JP) ..... 2003-120838

(51) Int. Cl.
*H01J 27/00* (2006.01)

(52) U.S. Cl. ..... 250/423 F; 250/423 R; 34/248

(58) Field of Classification Search ..... 34/248
See application file for complete search history.

(56) References Cited

U.S. PATENT DOCUMENTS

| | | | | |
|---|---|---|---|---|
| 4,734,621 | A | 3/1988 | Yonnet et al. | 315/111.41 |
| 6,146,462 | A | 11/2000 | Yializis et al. | 118/718 |
| 6,351,075 | B1 | 2/2002 | Barankova et al. | 315/111.71 |
| 6,374,511 | B1 | 4/2002 | Iwata | 34/248 |

FOREIGN PATENT DOCUMENTS

| | | |
|---|---|---|
| JP | 61 222533 | 10/1986 |
| JP | 2002-115174 | 4/2002 |

*Primary Examiner*—Tuyet Thi Vo
(74) *Attorney, Agent, or Firm*—Merchant & Gould P.C.

(57) ABSTRACT

An apparatus for activating an ionizable product is provided, which includes means for generating a magnetic field and means for applying plasma particles by corona discharge to the ionizable product placed on the means for generating the magnetic field.

6 Claims, 5 Drawing Sheets

APPARATUS FOR ACTIVATING A PRODUCT BY APPLYING PLASMA PARTICLES IN A MAGNETIC FIELD

BACKGROUND OF THE INVENTION

The present invention relates to an apparatus for activating an ionizable product. More particularly, the invention relates to an apparatus for activating an ionizable product capable of accelerating activation by using a magnetic field.

The applicant of the present invention proposed a method and apparatus for activating textile products in Japanese Published Patent Application 2002-115174.

In the method and apparatus disclosed in the application, a textile product is placed in a magnetic field so as to emit ionized gas to the textile product, taking into account the fact that ionized gas is able to activate textile products. Accordingly, the textile product can be activated uniformly because the ionized gas is attracted by the magnetic field to penetrate the textile product through fibers and the gap between the fibers, reaching the back of the textile product. In this instance, activation of textile products refers to any condition refreshing textile products, such as recovery of elasticity, improvement of hygroscopicity, improvement of the aesthetic property, addition of luster, deodorization and bleaching.

In this connection, it has been conventionally considered that ions (hereinafter referred to as "plasma particles"), in a state of ionized gas attached to ozone, conduct ionization by contacting with the surface of a product to be processed. The applicant applied ozone to a plurality of laminated fabrics, finding that all fabrics were activated even if no ozone was detected among the fabrics. Namely, it was found that plasma particles instead of ionized gas penetrated the product, thereby conducting ionization. Therefore, if a greater force of attracting plasma particles allows these particles to penetrate the product, it may be possible to activate any ionizable material such as metal and wood.

However, the applicant has found that the conventional method is insufficient in attraction of plasma particles and requires improvement when it is applied to ionizable materials such as metal and wood.

Furthermore, when the activation method and apparatus disclosed in the patent application described above are applied to thick fabrics, futons and the like, it is necessary to turn over these products several times and emit ionized gas to them each time, accordingly. Thus, the method and apparatus have a drawback to be solved.

SUMMARY OF THE INVENTION

The invention seeks to provide an apparatus for activating an ionizable product capable of activating the whole part of the ionizable product efficiently at a time by increasing penetration of plasma particles into the ionizable product.

The applicant has successfully solved the above problems by introducing the following apparatus after an in-depth examination.

According to an aspect of the present invention, an apparatus for activating an ionizable product is provided, which includes means for generating a magnetic field and means for applying plasma particles by corona discharge to the ionizable product placed on the means for generating the magnetic field.

The apparatus described above emits the plasma particles to the ionizable product, which is placed on the means for generating the magnetic field. Because the plasma particles are strongly attracted and accelerated in the magnetic field, they are able to penetrate the ionizable product. In this instance, the plasma particles are meant to represent charged particles contained in plasma.

According to another aspect of the present invention, an apparatus for activating an ionizable product is provided, in which the north pole of the means for generating the magnetic field is directed toward the means for applying the plasma particles.

In the apparatus described above, the north pole of the means for generating the magnetic field is directed toward the means for applying the plasma particles. The reason for this is that the applicant has found that plasma particles are more strongly attracted to the north pole. Thus, when the means for applying the plasma particles emits plasma particles to an ionizable product, which is placed on the means for generating the magnetic field, the plasma particles are strongly attracted and accelerated along a line of magnetic force in the magnetic field, thereby penetrating the ionizable product.

According to still another aspect of the present invention, an apparatus for activating an ionizable product is provided, in which the means for generating the magnetic field includes permanent magnets and magnetically permeable plates between which the permanent magnets are inserted.

The apparatus described above, in which the permanent magnets are inserted between the magnetically permeable plates, can intensify the magnetic force, thereby enlarging the magnetic field. Therefore, the apparatus is able to increase the attraction of the plasma particles and accelerate them, so that the plasma particles can penetrate the ionizable product. In addition, it may be possible to apply the apparatus to ionizable products with a greater height or thickness because it is possible to select a larger distance between the means for generating the magnetic field and the means for applying the plasma particles, as a result of the increased attraction of the plasma particles.

According to yet another aspect of the present invention, an apparatus for activating an ionizable product is provided, in which the permanent magnets and the magnetically permeable plates are alternately layered.

The apparatus described above, which has the alternate layers of permanent magnets and magnetically permeable plates, makes it possible to increase the magnetic force, thereby enlarging the magnetic field. Therefore, the apparatus is able not only to increase penetration of the plasma particles through the ionizable product but also enable its application to ionizable products with a greater height or width.

According to a further aspect of the present invention, an apparatus for activating an ionizable product is provided, where the means for generating the magnetic field has a plate on which the ionizable product is placed, and the plate is positioned a predetermined distance apart from an uppermost magnetically permeable plate.

In the apparatus described above, because the magnetic force becomes larger at the location apart from the surface of the permanent magnet, a greater attractive force is produced for the plasma particles. For this reason, positioning the plate where the attractive force is intensified, it may be possible to accelerate the plasma particles passing nearby and make them penetrate the ionizable product on the plate.

The predetermined distance is meant to represent a distance between the magnetically permeable plate and the plate positioned where an appropriate attracting force for the plasma particles is established.

According to a still further aspect of the present invention, an apparatus for activating an ionizable product is provided, in which the means for generating the magnetic field is adapted to be freely movable forward and backward relative to the means for applying the plasma particles.

The apparatus described above can appropriately change the distance between them. In this way, the apparatus can appropriately change the distance, depending on a range of the magnetic field and the thickness of the ionizable product.

BRIEF DESCRIPTION OF THE DRAWINGS

FIG. 5A illustrates the inner part before activation, and FIGS. 5B and 5C after activation.

DESCRIPTION OF THE PREFERRED EMBODIMENTS

An embodiment of the present invention is now described with reference to the accompanying drawings.

a. Apparatus for Activating an Ionizable Product

Figure 1:
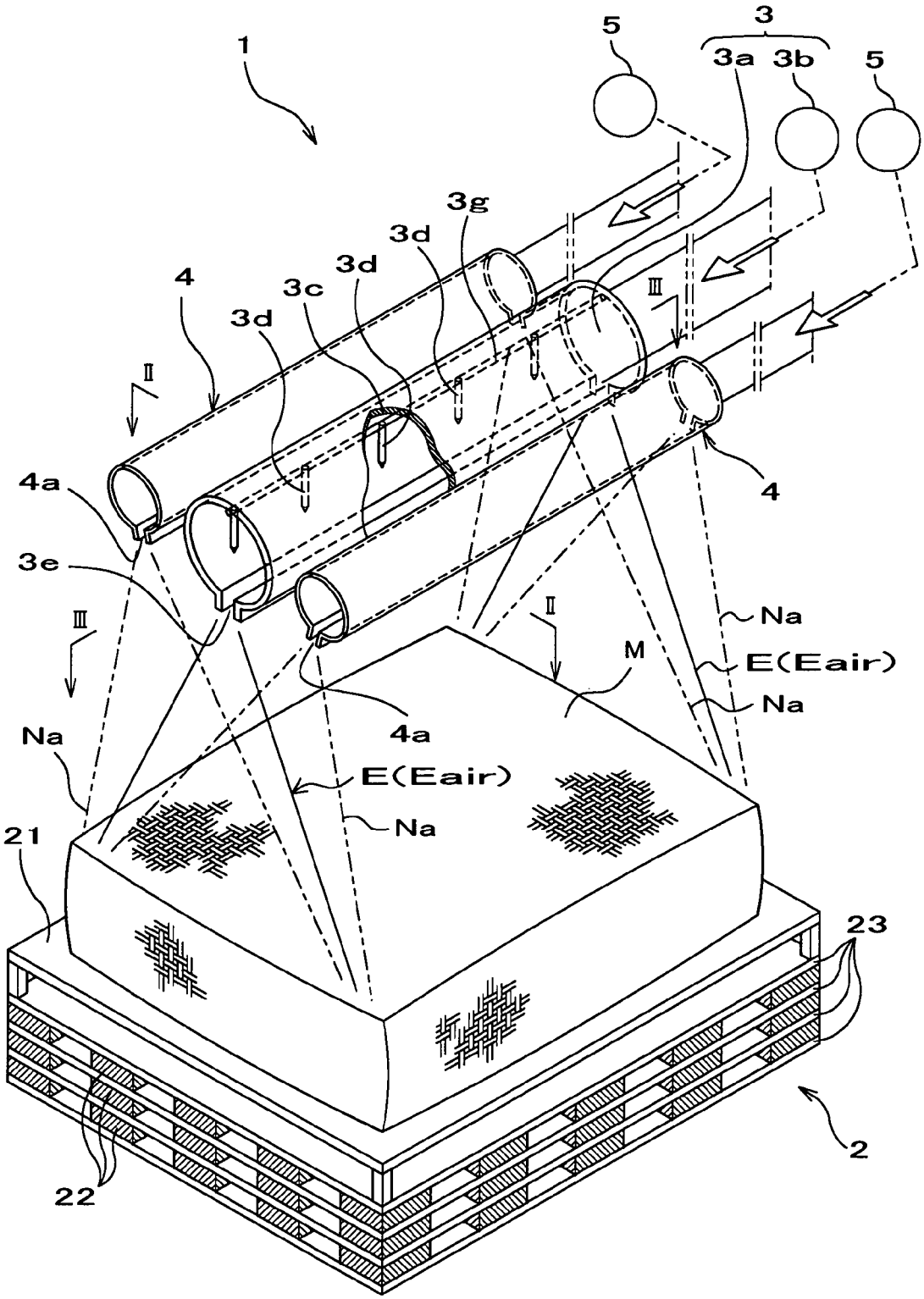
FIG. 1 is a perspective view showing an apparatus for activating an ionizable product according to the present invention.
Figure 2:
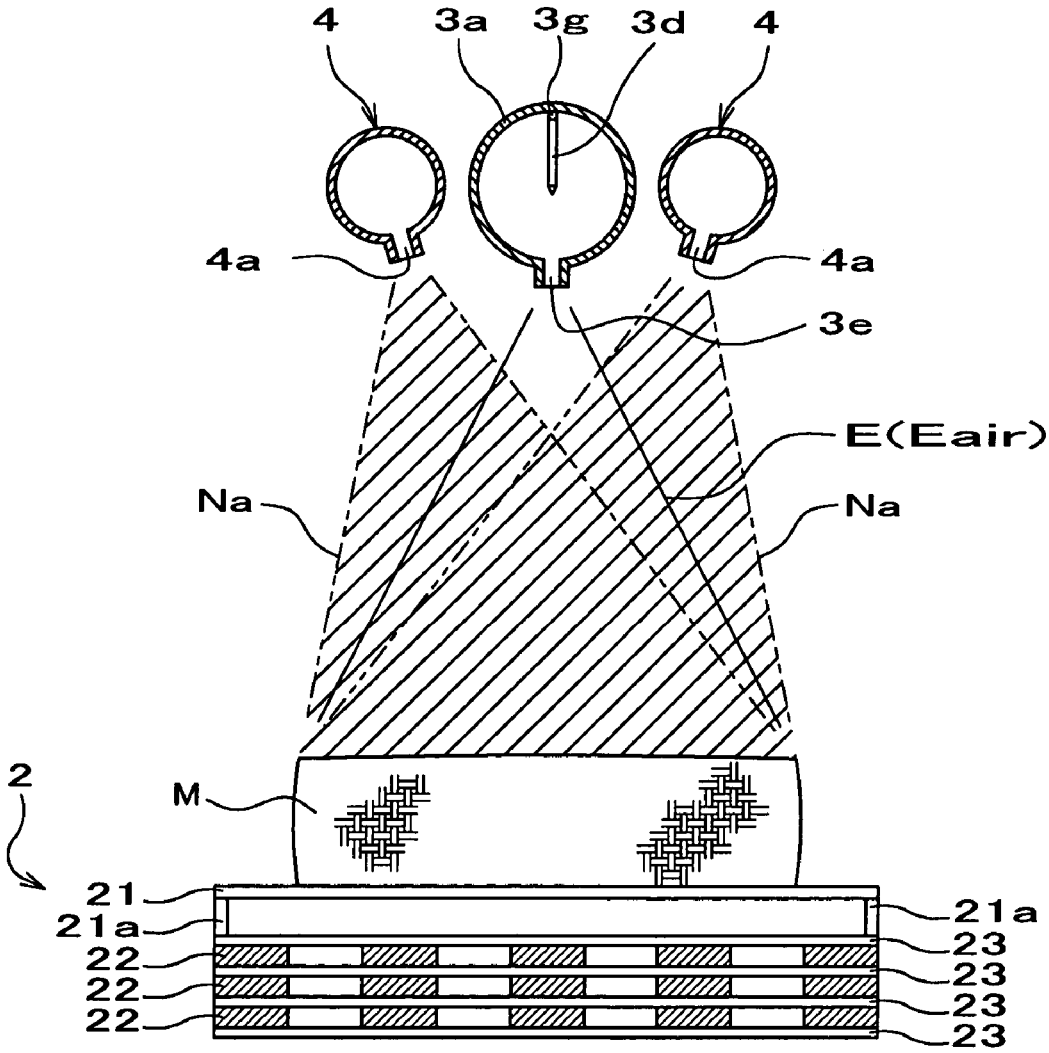
FIG. 2 is a cross-sectional view taken along line II—II in FIG. 1.
Figure 3:
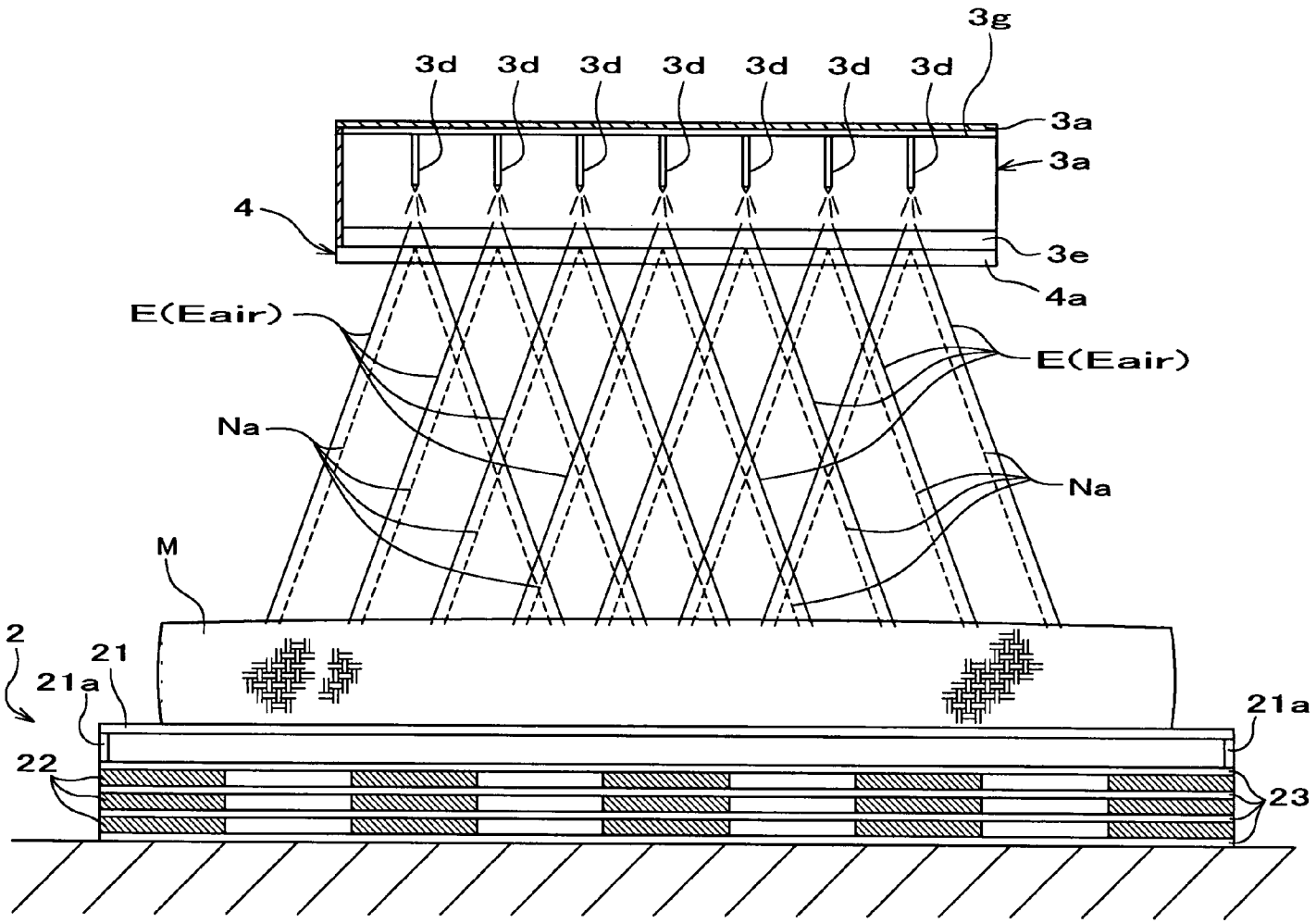
FIG. 3 is a cross-sectional view taken along line III—III in FIG. 1.

As shown in FIG. 1 to FIG. 3, an apparatus for activating an ionizable product (hereinafter simply referred to as "apparatus") 1 has means for generating a magnetic field such as a magnetic field generator 2 and means for applying plasma particles such as a corona discharge unit 3 for applying plasma particles E toward the magnetic field generator 2.

When the corona discharge unit 3 applies the plasma particles E to an ionizable product M, which is placed on the magnetic field generator 2, the apparatus 1 is able to activate the ionizable product M with the plasma particles E. In this connection, the ionizable product M is meant to represent any material that can be ionized, including such materials as a textile fabric, glass, wood and metal.

b. Magnetic Field Generator

Figure 4:
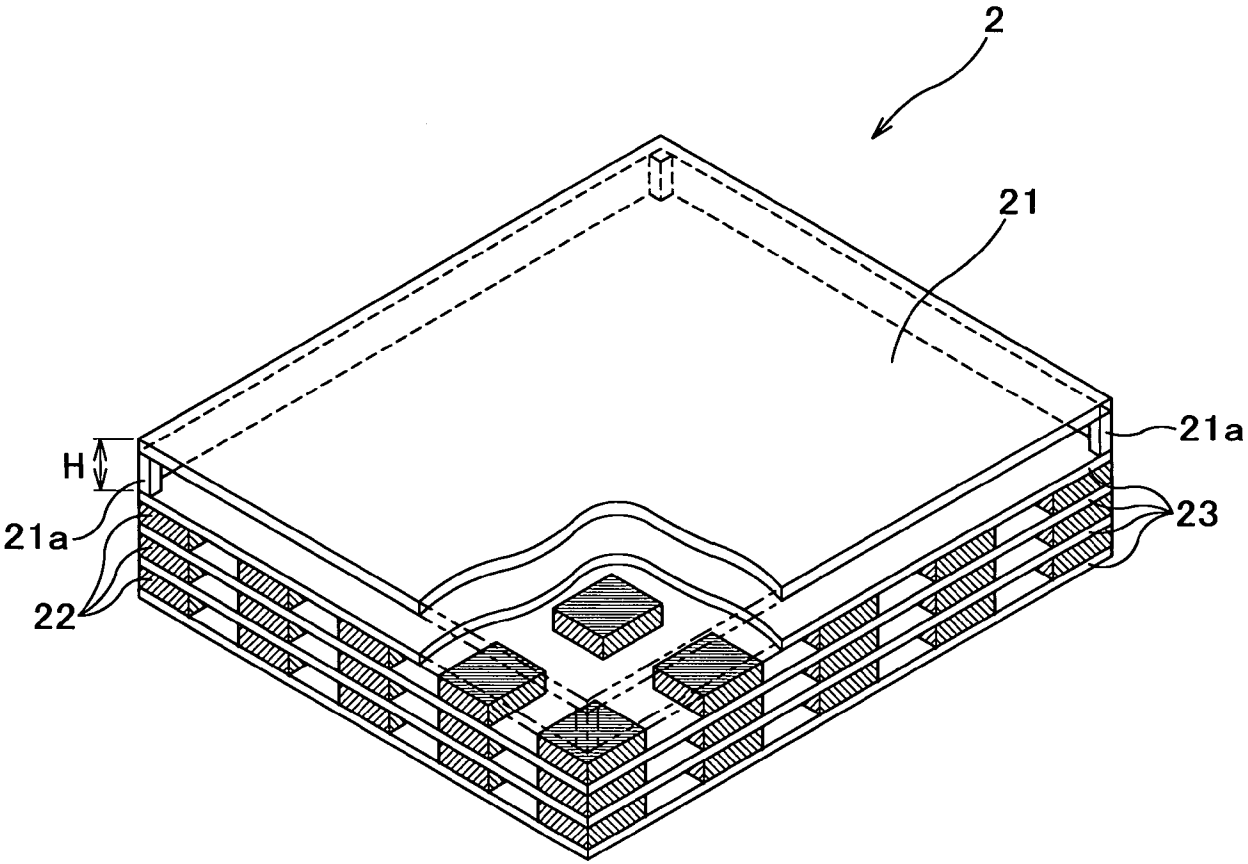
FIG. 4 is a partial cross-sectional perspective view showing a magnetic field generator according to the present invention.

FIG. 4 is a partial cross-sectional perspective view illustrating the magnetic field generator 2.

As shown in FIG. 4, the magnetic field generator 2 includes a plate 21 on which the ionizable product M is placed, a plurality of permanent magnets 22 for generating a magnetic field and magnetically permeable plates such as a plurality of iron plates 23. The permanent magnets 22 and iron plates 23 are alternately layered. An uppermost iron plate 23 is adapted to be positioned a predetermined distance away from the plate 21.

For example, a flat plate of plywood can be used for the plate 21. Fixtures 21*a* for fixing the uppermost iron plate 23, to be explained later, are provided at four corners of the plate 21. The fixtures 21*a* fix the plate 21 and the uppermost iron plate 23, spacing them a predetermined distance. In the present embodiment, the predetermined distance H between the plate 21 and the uppermost iron plate 23 is adapted to be 10 cm, for example. In this connection, the predetermined distance H may be changed as the case may be. Accordingly, it may be possible to position the plate 21 in such a location where an appropriate magnetic force can be obtained in a magnetic field produced by the permanent magnets 22.

The permanent magnets 22 include casting magnets (metallic magnets) such as an Alnico magnet and an iron-chromium-cobalt magnet, ferrite magnets (oxide magnets) such as a sintered magnet and a bond magnet, and rare earth magnets (rare earth derived magnets) such as Sm—Co (Samarium Cobalt) magnet and Nd—Fe—B (Neodymium Iron Boron) magnets.

The permanent magnets 22 are arranged between the iron plates 23 in such a manner that their north poles are directed toward the corona discharge unit 3. The north poles have a strong force to attract the plasma particles E, thus accelerating the applied plasma particles E along a line of magnetic force. Furthermore, it may be possible to increase the magnetic force so as to enlarge the magnetic field because the plural permanent magnets 22 are arrayed between the iron plates 23.

It is noted that the permanent magnets 22 are spaced an appropriate distance relative to each other so that they may not generate a mutually repulsive magnetic field. In this way, it may be possible that such arrangement enlarges the magnetic field.

The iron plates 23, between which the permanent magnets 22 are inserted, are permeable to the magnetic force generated by the permanent magnets 22. It may be preferable to adapt the thickness of an iron plate 23 to be substantially the same as that of a permanent magnet 22 in order to increase the magnetic force. In this connection, it is not limited to the iron plate 23, which is selected as an example of a magnetically permeable plate in the present embodiment, but it may be possible to alternatively select any plate as long as it is permeable to a magnetic force. The present embodiment, which has three layers of the permanent magnets 22 and the iron plates 23, can provide a greater magnetic force.

The magnetic field generator 2 described above has an elevation mechanism (not shown), which is able to set the generator 2 in close and remote positions relative to the corona discharge unit 3. Accordingly, it may be possible to change a distance between the corona discharge unit 3 and the magnetic field generator 2, depending on the magnetic field generator 2, the range of generated magnetic field and the like. For example, when the magnetic field generator 2 is used, which has three layers of the permanent magnets 22 and the iron plates 23, it may be possible to select a larger distance between the corona discharge unit 3 and the magnetic field generator 2 than when another magnetic field generator of two layers is used, because the magnetic field can be enlarged in the case of three layers. In this connection, it may be possible to appropriately adjust the distance between them, depending on the thickness and material of the ionizable product M to be activated.

c. Corona Discharge Apparatus

As shown in FIG. 1 to FIG. 3, the corona discharge unit 3 includes a corona discharge part 3*a* and a compressor 3*b* supplying a gas (for example, an argon, helium or nitrogen gas, or air) to the corona discharge part 3*a*.

The corona discharge part 3*a* includes a cylindrical member 3*c* having a predetermined length, and a plurality of electrodes 3*d* for corona discharge attached to the internal surface of the cylindrical member 3*c*. These electrodes 3*d* are electrically connected with a common electrode 3*g*. The cylindrical member 3*c* has a slit-like aperture 3*e*, through which plasma particles E travel out, on its opposite side of the electrodes 3*d*.

The axial length of the cylindrical member 3*c* is adapted to correspond to the maximum width of the plate 21, and the aperture 3*e* is formed for the cylindrical member 3*c*, thoroughly from one end to the other. In this way, the plasma particles E traveling through the aperture 3*e* can be applied to all over the surface of an ionizable product M placed on the plate 21.

It may be preferable to adjust the voltage, which is imposed between the electrodes 3*d* and the inner surface of the cylindrical member 3*c*, to be equal to a value just lower than the one at which generation of an arc starts, for example, 11000 V. When an inert gas such as an argon, helium or nitrogen gas, is supplied to the cylindrical member 3*c*, a gas storage tank or cylinder may be directly connected to the cylindrical member 3*c*.

When the corona discharge unit 3 is in operation to generate corona discharge between the cylindrical member 3*c* and electrodes 3*d*, the gas (an argon, helium or nitrogen gas, or air, for example) supplied to the cylindrical member 3*c* is polarized and ionized, and the plasma particles E are applied toward the plate 21 through the aperture 3*e* by means of energy of corona discharge. In this connection, an ionized gas is referred to as plasma E.sub.air which contains the plasma particles E.

Air supply units 4 for blowing natural air Na to the plasma E.sub.air are disposed on both sides of the corona discharge unit 3. An air outlet 4*a* of an air supply unit 4 is diagonally directed downward so that the natural air Na can join the plasma E.sub.air, which is supplied through the aperture 3*e*, before the plasma E.sub.air arrives at the ionizable product M. Compressors 5 for supplying the natural air Na are connected to the air supply units 4, respectively. In this way, the plasma particles E contained in the plasma E.sub.air are accelerated toward the ionizable product M by the natural air Na.

d. Operational Description for an Apparatus

As shown in FIGS. 1 to 3, the corona discharge unit 3 is positioned above the plate 21 and the aperture 3*e* of the corona discharge part 3*a* is adapted to face the top surface of the plate 21. An appropriate distance between the top surface of the plate 21 and the aperture 3*e* may be determined as the case may be.

When the plasma E.sub.air is applied to the ionizable product M for activation, the air supply units 4 are provided on both sides of the cylindrical member 3*c* of the corona discharge unit 3.

A control panel (not shown) is prepared for controlling the discharge voltage of the corona discharge unit 3. The discharge voltage is set to be a value, just lower than that at which an arc occurs at the electrodes 3*d*.

When the corona discharge unit 3 is in operation, gas is supplied to the cylindrical member 3*c* of the corona discharge unit 3. Air or an inert gas such as an argon or helium gas, for example, which is supplied to the cylindrical member 3*c*, is ionized by means of corona discharge at the electrodes 3*d*, and applied to the ionizable product M through the aperture 3*e* by the discharge energy.

When the plasma particles E are applied to the ionizable product M, the air outlet 4*a* of the air supply unit 4 is adapted to confront the plasma E.sub.air. In this way, it may be possible to supply the natural air Na through the air outlet 4*a* so that it can accelerate the plasma particles E contained in the plasma E.sub.air.

e. Activation of an Ionizable Product

Figure 5A:
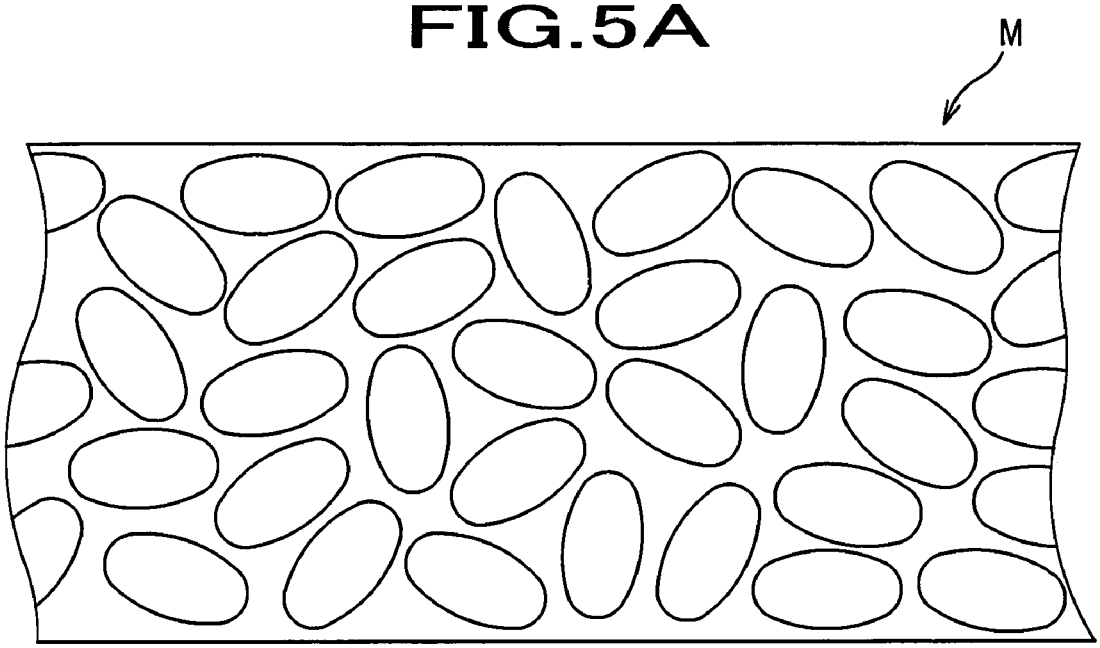
FIGS. 5A to 5C are cross-sectional views schematically showing the inner part of an ionizable product.
Figure 5B:
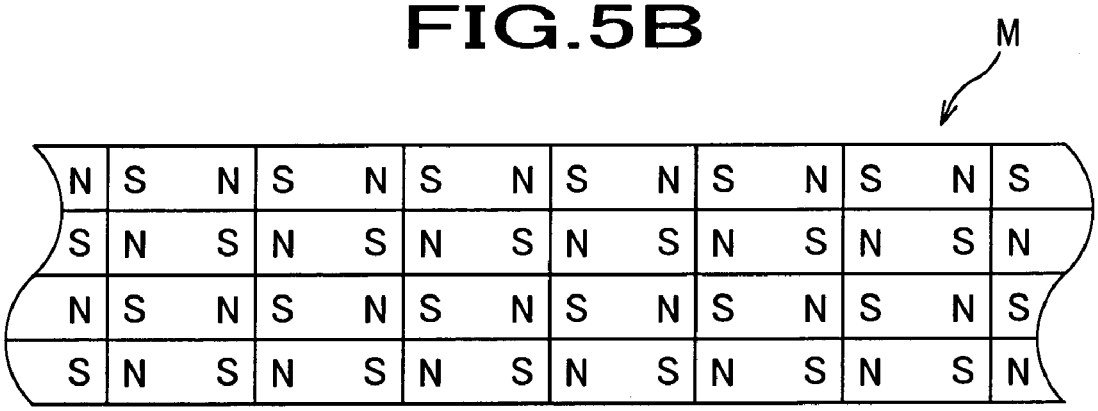
Figure 5C:
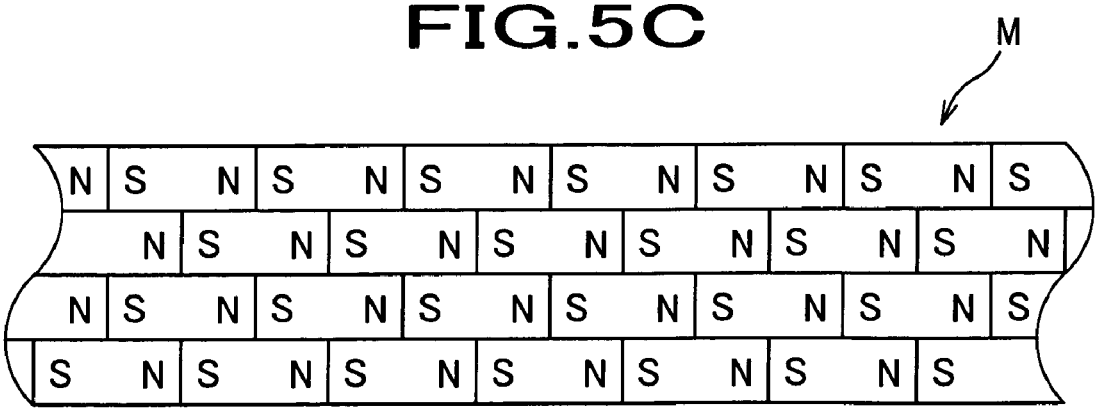

FIGS. 5A, 5B and 5C are cross-sectional views illustrating the inner part of an ionizable product: FIG. 5A illustrates a condition prior to application of plasma particles, and FIGS. 5B and 5C conditions after application of plasma particles.

It is generally considered that molecules of the ionizable product M stand dispersed at random without electrification as shown in FIG. 5A. When the plasma particles E are applied to the ionizable product M, they are strongly attracted along a line of magnetic force toward the north pole N of the magnetic field generated by the magnetic field generator 2, penetrating the ionizable product M to reach its back. Consequently, as shown in FIG. 5B or 5C, the molecules existing inside the ionizable product M are activated to generate a magnetic field, so that the molecules are regularly arranged, the respective north poles N and south poles S confronting relative to each other.

EXAMPLES

Description is given to physical changes in an ionizable product M, to which plasma E.sub.air was applied by an apparatus 1.

The magnetic field generator 2 of the apparatus 1 used in an experiment employed three layers of permanent magnets and iron plates. The number of magnets was 88 and each magnet had 8000 gausses. Discharge voltage of the corona discharge unit 3 was adapted to be 11000 V and the distance between the aperture 3*e* and the top surface of the plate 21 was substantially adapted to be 60 cm. In this connection, the ambient temperature and humidity were controlled to be 18° C. and 40% to 60%, respectively.

A feather futon packed in an approximately 35-cm high plastic bag, glasses, woods and metals were selected for ionizable products M, for example. Observation was made for changes in physical properties before and after application of the plasma E.sub.air.

First, activation of the feather futon packed in the bag was assessed by measurement of a bulk height, measurement of time required of water drops completely absorbed by the futon when dropped from the same height and comparison of a visual or olfactory difference.

According to the assessment, the feather futon increased in bulk height by 1.5 times. This suggested that application of plasma E.sub.air to the north pole of the magnetic field generator 2 increased the force to attract the plasma particles E, resulting in successful penetration of the plasma particles E through the thick feather futon and its activation. In addition, it was found that the water absorption of the feather futon was improved, to which plasma E.sub.air was applied, because its speed of water absorption increased. In this way, the feather futon after activation acquired a higher heat of wetting and more comfortable warmth.

Furthermore, it was visually observed that the feather futon after activation gained a luster on its cloth and became more pliant. It was also found that the feather futon no longer had an intrinsic odor and turned almost odorless.

Activation of glasses was assessed by comparison of a visual difference and measurement of hardness.

According to the assessment, it was visually observed that the activated glasses had higher transparency compared with those without activation. The reason for this is that the molecules inside the glasses were regularly arrayed. Also it was found that the activated glasses acquired higher hardness, thereby improving their quality.

Activation of woods and metals was assessed by comparison of a visual difference and measurement of strength.

According to the assessment, it was visually observed that the woods and metals acquired an external luster as if polished. Observation of the inside of broken woods showed that an internal luster was acquired as well as the external one, which demonstrated a clear difference compared with those without activation. It was also found that these activated woods had higher strength than those without activation.

It is considered that the effects described above resulted from the phenomenon that the molecules existing dispersed at random before activation were regularly arrayed as a result of penetration of a great amount of plasma particles E through the ionizable product M. This penetration was induced by application of the plasma E.sub.air, which the north pole of the magnetic field generator 2 forcefully attracted and confined. It was, therefore, estimated that the ionizable product M was not only externally but also internally improved.

The apparatus 1, which applies the plasma particles E to the north pole of the magnetic field generator 2, allows the plasma particles E to penetrate ionizable products such as a feather futon packed in a bag, glass, wood and metal, which plasma particles applied by a conventional apparatus with weak magnetic force will not penetrate. Therefore, it is apparent that the apparatus of the present invention is remarkably superior to the conventional one.

The apparatus 1 described above can place a bulky feather futon packed in a bag and the like on the plate and activate it because it is possible to select a larger distance between the corona discharge unit 3 and the magnetic field generator 2 as a result of strengthening of the magnetic force. In this way, it may be possible to make the plasma particles E penetrate the bulky feather futon so as to activate it at a time. Therefore, the apparatus of the present invention has not only industrial but also economical advantages.

The apparatus 1 is also able to activate a feather futon so as to maintain a similar bulk height even if its amount of feather is reduced, 1.4 kg to 0.8 kg, for example.

In this instance, because the amount of the plasma particles E (E.sub.air) is variable depending on the type of discharge, the distance between the aperture 3*e* and the top surface of the plate 21 may be selected so that all the plasma particles E (E.sub.air) generated by discharging can be applied to an ionizable product M.

When it is necessary to enlarge the magnetic field generated by the magnetic field generator 2, it may be preferable that one of the following be adapted to increase: the number of layers of the permanent magnets 22, the thickness of the iron plate 23, which should not exceed that of a permanent magnet 22, the dimensions of the permanent magnet 22. The magnetic field generator 2 described above can thus be compact and economically advantageous.

In addition, the apparatus 1, which does not require dedicated operating conditions such as temperature, pressure and the like as a result of strengthening a force for attracting the plasma particles E by directing the north pole of the magnetic field generator 2 toward the corona discharge unit 3, is able to conduct activation under the conditions of normal temperature, atmospheric pressure and unconfined configuration.

Though the slit-like aperture 3*e* is selected as an example of the aperture for applying plasma particles E (E.sub.air) in the present embodiment, a plurality of apertures may alternatively be adopted, each of which is adapted to confront each of the electrodes 3*d*.

It will now be appreciated from the foregoing description that the present invention is not limited to the particularly illustrated embodiment discussed above and may be carried out in various modified forms.

What is claimed is:

1. An apparatus for activating an ionizable product comprising:

means for generating a magnetic field;

means for applying plasma particles by corona discharge to the ionizable product placed on the means for generating the magnetic field; and wherein the means for generating the magnetic field comprises permanent magnets and magnetically permeable plates between which the permanent magnets are inserted.

2. An apparatus as set forth in claim 1 wherein the north pole of the means for generating the magnetic field is directed toward the means for applying plasma particles.

3. An apparatus as set forth in claim 1 wherein the means for generating the magnetic field has a plate on which the ionizable product is placed, and the plate is positioned a predetermined distance apart from an uppermost magnetically permeable plate.

4. An apparatus as set forth in claim 1 wherein the means for generating the magnetic field is adapted to be freely movable forward and backward relative to the means for applying the plasma particles.

5. An apparatus as set forth in claim 1 wherein the permanent magnets and the magnetically permeable plates are alternately layered.

6. An apparatus as set forth in claim 5 wherein the means for generating the magnetic field has a plate on which the ionizable product is placed, and the plate is positioned a predetermined distance apart from an uppermost magnetically permeable plate.

* * * * *